US005942485A

United States Patent [19]

Kemen

[11] Patent Number: 5,942,485

[45] Date of Patent: Aug. 24, 1999

[54] STABLE CONCENTRATED LIQUID LAUNDRY DETERGENT COMPOSITION CONTAINING ALKYL POLYETHOXYLATE SULFATE AND POLYHYDROXY FATTY ACID AMIDE SURFACTANTS AND TOLUENE SULFONATE SALT

[75] Inventor: Kenneth M. Kemen, Cincinnati, Ohio

[73] Assignee: The Procter & Gamble Company, Cincinnati, Ohio

[21] Appl. No.: 08/596,983

[22] Filed: Feb. 5, 1996

Related U.S. Application Data

[63] Continuation of application No. 08/239,153, May 6, 1994, abandoned.

[51] Int. Cl.[6] ..... C11D 1/12; C11D 1/72; C11D 3/32

[52] U.S. Cl. ..... 510/502; 510/350; 510/351; 510/352; 510/356; 510/357; 510/427; 510/433

[58] Field of Search ..... 510/350, 351, 510/352, 356, 357, 427, 433, 502

[56] References Cited

U.S. PATENT DOCUMENTS

| | | | |
|---|---|---|---|
| 1,985,424 | 12/1934 | Piggott | 252/548 |
| 2,662,073 | 12/1953 | Mehltretter et al. | 252/548 |
| 2,703,798 | 3/1955 | Schwartz | 252/548 |
| 2,965,576 | 12/1960 | Wilson | 252/548 |
| 3,928,249 | 12/1975 | Nunziata et al. | 252/526 |
| 4,199,464 | 4/1980 | Cambre | 252/99 |
| 4,284,532 | 8/1981 | Leikhim et al. | 252/528 |
| 4,285,841 | 8/1981 | Barrat et al. | 252/559 |
| 4,487,710 | 12/1984 | Kaminsky | 252/546 |
| 4,704,221 | 11/1987 | Bleil et al. | 252/91 |
| 4,747,977 | 5/1988 | Whitehead et al. | 252/111 |
| 5,009,814 | 4/1991 | Kelkenberg et al. | 252/548 |
| 5,089,174 | 2/1992 | Kaw et al. | 252/553 |
| 5,174,927 | 12/1992 | Honsa | 252/543 |
| 5,188,769 | 2/1993 | Connor et al. | 252/548 |
| 5,269,974 | 12/1993 | Ofosu-Asante | 252/544 |
| 5,283,009 | 2/1994 | Speckman et al. | 252/548 |
| 5,415,801 | 5/1995 | Ofosu-Asante | 252/174.17 |

FOREIGN PATENT DOCUMENTS

| | | | |
|---|---|---|---|
| WO 92/06156 | 4/1992 | WIPO | C11D 1/62 |
| WO 92/06158 | 4/1992 | WIPO | C11D 1/65 |
| WO 92/06171 | 4/1992 | WIPO | C11D 17/00 |
| WO 93/05132 | 3/1993 | WIPO | C11D 1/65 |
| WO 94/09100 | 4/1994 | WIPO | C11D 1/52 |

*Primary Examiner*—Yogendra Gupta
*Assistant Examiner*—Charles Boyer
*Attorney, Agent, or Firm*—Steven R. Chuey; Kim W. Zerby; Jacobus C. Rasser

[57] ABSTRACT

Concentrated heavy duty liquid laundry detergent compositions containing an anionic surfactant component, polyhydroxy fatty acid amide surfactant and a water-soluble salt of toluene sulfonic acid, and containing no more than about 50% water. The concentration of all surfactants in the detergent compositions is greater than about 10% by weight of the composition. The anionic surfactant component comprises between about 50% and 100% alkyl polyethoxylate sulfates. The compositions are substantially clear and isotropic when prepared and remain stable after extended periods of time and under extreme conditions. Toluene sulfonate salts, although known hydrotropes, provides improved phase stability to the compositions unlike other standard hydrotropes and solvents.

8 Claims, No Drawings

STABLE CONCENTRATED LIQUID LAUNDRY DETERGENT COMPOSITION CONTAINING ALKYL POLYETHOXYLATE SULFATE AND POLYHYDROXY FATTY ACID AMIDE SURFACTANTS AND TOLUENE SULFONATE SALT

This is a continuation of application Ser. No. 08/239,153, filed on May 6, 1994 now abandoned.

TECHNICAL FIELD

The present invention relates to concentrated, aqueous heavy duty liquid laundry detergent compositions containing alkyl polyethoxylate sulfate surfactant, polyhydroxy fatty acid amide surfactant, and a water-soluble salt of toluene sulfonic acid. The compositions are substantially clear and isotropic when prepared and remain stable over extended periods of time and under extreme conditions.

BACKGROUND OF THE INVENTION

Recently, there has been considerable interest within the detergent industry in liquid detergent compositions which are "concentrated" and, therefore, have low dosage volumes. Many attempts have been made to produce these concentrated products with less than about 50% water and higher active ingredient levels in the product. These low dosage, concentrated products are currently in high demand since they conserve resources and can be sold in smaller packages which are more convenient for consumers.

Moreover, liquid detergents containing anionic and nonionic surfactants, and capable of providing superior cleaning performance, are currently on the market. Some of these compositions contain alkyl polyethoxylate sulfate and/or polyhydroxy fatty acid amide surfactants to enhance removal of grease/oil stains. The stabilization of liquid detergent products containing high levels of these surfactants and other optional active ingredients and lower levels of water is particularly difficult because the hydroxyl and ethoxy groups of surfactants hydrogen bond with water molecules making them immobile.

Hydrotropes, including compounds such as sodium benzene sulfonate, sodium toluene sulfonate, sodium cumene sulfonate and sodium xylene sulfonate, are well known in the liquid detergent field particularly for their characteristic ability to increase the aqueous solubility of various slightly soluble organic chemicals. However, many of these compounds have been found to be ineffective in providing phase stability to concentrated heavy duty liquid detergent compositions containing anionic surfactant (including alkyl polyethoxylate sulfate surfactant) and polyhydroxy fatty acid amide surfactant.

Despite the fact that it is difficult to formulate a clear, homogeneous and phase stable liquid laundry detergent composition containing higher levels of anionic surfactant and polyhydroxy fatty acid amide surfactant and lower levels of water, it has been found that the phase stability of these detergent compositions is improved by utilizing water-soluble salts of toluene sulfonic acid in the liquid detergent compositions. Similar compositions containing other known hydrotropes, e.g., sodium cumene sulfonate and sodium xylene sulfonate, do not provide the requisite phase stability.

SUMMARY OF THE INVENTION

The present invention encompasses concentrated heavy duty liquid laundry detergent composition comprising, by weight of the composition:

a) from about 5% to about 40% of an anionic surfactant component which comprises between about 50% and 100% of alkyl polyethoxylate sulfates wherein the alkyl group contains from about 10 to about 22 carbon atoms and the polyethoxylate chain contains from 1 to about 4 ethylene oxide moieties;

b) from about 1% to about 10% of a polyhydroxy fatty acid amide surfactant of the formula:

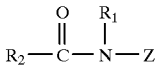

wherein $R_1$ is H, $C_1$–$C_4$ hydrocarbyl, 2-hydroxy ethyl, 2-hydroxy propyl, methoxy ethyl, methoxy propyl, or a mixture thereof, $R_2$ is $C_5$–$C_{31}$ hydrocarbyl, and Z is a polyhydroxyhydrocarbyl having a linear hydrocarbyl chain with at least 3 hydroxys directly connected to said chain, or an alkoxylated derivative thereof;

c) from about 1.5% to about 8% of a water-soluble salt of toluene sulfonic acid; and d) no more than about 50% of water;

wherein the concentration of all surfactants in the detergent composition is greater than about 10% by weight of the composition.

DETAILED DESCRIPTION OF THE INVENTION

In accordance with the present invention, it has now been found that a stable, aqueous, concentrated heavy duty liquid detergent composition is surprisingly formed when anionic surfactant, polyhydroxy fatty acid amide surfactant and a water-soluble salt of toluene sulfonic acid are combined in relative proportions specified hereinafter. The composition is substantially clear and isotropic and provide notable cleaning benefits. As used herein, "concentrated" detergent composition indicates that the composition contains higher levels of active ingredients (including surfactants) and lower levels of water. As used herein, the term "isotropic" indicates a single continuous phase, e.g., a liquid. A slurry or liquid having suspended crystals, precipitates or more than one liquid or liquid crystalline phase would not fall within the scope thereof. As used herein, the term "substantially clear" means aesthetically clear, transparent or translucent.

The heavy duty liquid laundry detergent compositions herein contain an anionic surfactant component, a polyhydroxy fatty acid amide surfactant, a water-soluble salt of toluene sulfonic acid and water as essential ingredients.

Anionic Surfactant Component

The detergent compositions herein comprise from about 5% to about 40%, preferably from about 10% to about 25%, by weight of the detergent composition, of an anionic surfactant component. The anionic surfactant component comprises alkyl polyethoxylate sulfates, and may contain other non-soap anionic surfactants, or mixtures thereof. The concentration of all surfactants in the detergent composition is greater than about 15%, preferably from about 20% to about 40%, by weight of the composition.

Generally speaking, anionic surfactants useful herein are disclosed in U.S. Pat. Nos. 4,285,841, Barrat et al, issued Aug. 25, 1981, and in 3,919,678, Laughlin et al, issued Dec. 30, 1975, both incorporated herein by reference.

Particularly preferred anionic surfactants herein are the alkyl polyethoxylate sulfates of the formula $$RO(C_2H_4O)_xSO_3^-M^+$$

wherein R is an alkyl chain having from about 10 to about 22 carbon atoms, saturated or unsaturated, and the longest linear portion of the alkyl chain is 15 carbon atoms or less on the average, M is a cation which makes the compound water-soluble, especially an alkali metal, ammonium or substituted ammonium cation, and x is from 1 to about 4. The anionic surfactant component of the present compositions comprises from about 50% to about 100%, preferably from about 75% to about 100%, by weight of the detergent composition, of alkyl polyethoxylate sulfates as described above.

Other anionic surfactants useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulphonates, primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl tarates, fatty acid amides of methyl tauride, alkyl succinamates and sulfosuccinates, monoesters of sulfosuccinate (especially saturated and unsaturated $C_{12}$–$C_{18}$ monoesters), diesters of sulfosuccinate (especially saturated and unsaturated $C_6$–$C_{14}$ diesters), N-acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO^-M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates Containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Other useful anionic surfactants are the non-ethoxylated $C_{12-15}$ primary and secondary alkyl sulfates. Under cold water washing conditions, i.e., less than abut 65° F. (18.3° C.), it is preferred that there be a mixture of such ethoxylated and non-ethoxylated alkyl sulfates.

Mixtures of the alkyl sulfates with the above-described paraffin sulfonates, alkyl glyceryl ether sulfonates and esters of a α-sulfonated fatty acids, are also preferred.

The anionic surfactant component may also comprise alkyl benzene sulfonates in which the alkyl group contains from about 9 to about 15 carbon atoms, in straight chain or branched chain configuration, e.g., those of the type described in U.S. Pat. Nos. 2,220,099 and 2,477,383. Preferred are linear straight-chain alkylbenzene sulfonates in which the average number of carbon atoms in the alkyl group is from about 11 to 14.

Polyhydroxy Fatty Acid Amide Surfactant

The compositions hereof comprise at least about 1%, typically from about 1% to about 10%, preferably from about 2% to about 6%, of the polyhydroxy fatty acid amide surfactant described below.

The polyhydroxy fatty acid amide surfactant component of the present invention comprises compounds of the structural formula:

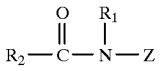

wherein: $R_1$ is H, $C_1$–$C_4$ hydrocarbyl, 2-hydroxy ethyl, 2-hydroxy propyl, methoxy ethyl, methoxy propyl, or a mixture thereof, preferably $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly —$CH_2$—$(CHOH)_4$—$CH_2OH$.

In Formula above, $R_1$ can be, for example, N-methyl, N-ethyl, N-propyl, N-isopropyl, N-butyl, N-2-hydroxy ethyl, or N-2-hydroxy propyl.

$R_2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd.; U.S. Pat. Nos. 2,965,576, issued Dec. 20, 1960 to E. R. Wilson; 2,703,798, Anthony M. Schwartz, issued Mar. 8, 1955; 1,985,424, issued Dec. 25, 1934 to Piggott; and 5,194,639, issued Mar. 16, 1993; and 5,188,769, issued Feb. 23, 1993; and 5,298,636, issued Mar. 29, 1994, each of which is incorporated herein by reference.

In a preferred process for producing N-alkyl or N-hydroxyalkyl, N-deoxyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxypropyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof The amount of catalyst is preferably from about 0.5 mole % to about 50 mole %, more preferably from about 2.0 mole % to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate.

The polyhydroxy "fatty acid" amide materials used herein also offer the advantages to the detergent formulator that they can be prepared wholly or primarily from natural, renewable, non-petrochemical feedstocks and are degradable. They also exhibit low toxicity to aquatic life.

It should be recognized that along with the polyhydroxy fatty acid amides hereof, the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amide-containing composition added to the detergent contains less than about 10%, preferably less than about 4%, of cyclic polyhydroxy fatty acid amide. The preferred processes described above are advantageous in that they can yield rather low levels of by-products, including such cyclic amide by-product.

Water-Soluble Salt of Toluene Sulfonic Acid

The compositions of the invention hereof also contain from about 1.5% to about 8%, preferably from about 2% to about 5% of a water-soluble salt of toluene sulfonic acid. The invention herein should be understood to cover toluene sulfonic acid. However, since the pH of the compositions of the present invention is typically in the alkaline range, the hydrotrope component exists primarily as the ionized salt in the aqueous compositions herein. In other words, although the hydrotrope may be added to the composition in its acidic form, it is likely to appear in the formula as a salt derivative.

The water-soluble salt of toluene sulfonic acid substantially increase the phase stability of the detergent compositions herein. This hydrotrope minimizes, prevents, or inhibits crystallization of certain ingredients in the aqueous composition.

Other known hydrotropes, including benzene sulfonate, cumene sulfonate, and xylene sulfonate, are ineffective in providing phase stability to the detergent compositions of the invention herein. Compositions containing higher levels of anionic surfactant, polyhydroxy fatty acid amide surfactant, lower levels of water and hydrotropic agents other than toluene sulfonate do not exhibit phase stability over an extended period of time or under extreme conditions.

The water-soluble salts useful in the present invention include the alkali metal, alkaline earth metal, alkyl amine and ammonium salts of toluene sulfonic acid. Preferred salts are sodium, potassium, and monoethanolamine toluene sulfonate, and mixtures thereof. Most preferred is sodium toluene sulfonate.

Water

Finally, the compositions herein contain no more than about 50%, preferably no more than about 45% water, by weight of the composition.

Auxiliary Detergent Surfactants

The compositions herein preferably also contain from about 1% to about 10%, preferably from about 1.5% to about 5%, of an ethoxylated nonionic surfactant. The weight ratio of synthetic anionic surfactant (on an acid basis) to nonionic surfactant is preferably from about 3:1 to about 20:1, more preferably from about 5:1 to about 15:1. The nonionic surfactant helps ensure the formation and absorption of sufficient hardness surfactant at the air/water interface to provide good greasy/oily soil removal.

The ethoxylated nonionic surfactant is of the formula $R^1(OC_2H_4)_nOH$, where $R^1$ is a $C_{10}$–$C_{16}$ alkyl group or a $C_8$–$C_{12}$ alkyl phenyl group, n is from about 3 to about 9, and said nonionic surfactant has an HLB (Hydrophilic-Lipophilic Balance) of do from about 6 to about 14, preferably from about 10 to about 13. These surfactants are more fully described in U.S. Pat. Nos. 4,285,841, Barrat et al., issued Aug. 25, 1981, and 4,284,532, Leikhim et al., issued Aug. 18, 1981, both incorporated herein by reference. Particularly preferred are condensation products of $C_{12}$–$C_{15}$ alcohol with from about 3 to about 8 moles of ethylene oxide per mole of alcohol, e.g., $C_{12}$–$C_{13}$ alcohol condensed with about 6.5 moles of ethylene oxide per mole of alcohol.

Other surfactants, useful in the present compositions at levels up to about 10% by weight, preferably up to about 5%, include the cosurfactants in U.S. Pat. No. 4,507,219, Hughes, issued Mar. 26, 1985; and the alkylpolysaccharides in U.S. Pat. No. 4,565,647, Llenado, issued Jan. 21, 1986, all incorporated herein by reference.

Optional Components

The compositions herein also preferably contain up to about 30%, more preferably from about 1% to about 20%, most preferably from about 1% to about 10%, by weight of a detergent builder material. While all manner of detergent builders known in the art can be used in the present compositions, the type and level of builder should be selected such that the final composition has an initial pH of from about 7.0 to about 9.0 at a concentration of from about 1% to about 10% by weight in water at 20° C. Detergent builders are described in U.S. Pat. No. 4,321,165, Smith et al, issued Mar. 23, 1982, incorporated herein by reference. In the preferred liquid detergent compositions herein, the builder preferably represents from about 1% to about 20%, more preferably from abut 3% to about 10%, by weight of the composition. Preferred builders for use in liquid detergents herein are described in U.S. Pat. No. 4,284,532, Leikhim et al, issued Aug. 18, 1981, incorporated herein by reference. A particularly preferred builder is citric acid.

Enzymes can be included in the formulations herein for a wide variety of fabric laundering purposes, including removal of protein-based, carbohydrate-based, or triglyceride-based stains, for example, and for fabric restoration. The enzymes to be incorporated include proteases, amylases, lipases, and cellulases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases. Particularly preferred compositions herein contain from about 0.05% to about 2% by weight of detersive enzymes, especially the amylases, proteases, and mixtures thereof, of the type well known to detergent formulators.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, a-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Diosynth Co., The Netherlands, and lipases ex Pseudomonas gladioli. The LIPOLASE enzyme derived from Humicola lanuginosa and commercially available from Novo (see also EPO 341,947) is a preferred lipase for use herein.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. Nos. 4,101,457, Place et al, issued Jul. 18, 1978, and in 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

The enzymes employed herein may be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species. See Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 4%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Other preferred components for use in liquid detergents herein are the neutralizing agents, buffering agents, phase regulants, hydrotropes, polyacids, suds regulants, opacifiers, antioxidants, bactericides, dyes, perfumes, and brighteners described in the U.S. Pat. No. 4,285,841, Barrat et al, issued Aug. 25, 1981, incorporated herein by reference. Preferred neutralizing agents for use herein are organic bases, especially triethanolamine and monoethanol amine, which results in better detergency performance than inorganic bases such as sodium and potassium hydroxides.

The following non-limiting examples illustrate the compositions of the present invention. All percentages, parts and ratios used herein are by weight unless otherwise specified.

EXAMPLE

The following liquid laundry detergent compositions are prepared by mixing the listed ingredients in the stated proportions. All components are listed on an acid basis unless otherwise stated.

| | Component | | | | | | |
|---|---|---|---|---|---|---|---|
| | 1 | 2 | 3 | 4 | 5 | 6 | 7 |
| | Weight Percent Active | | | | | | |
| Sodium $C_{12-15}$ alkyl polyethoxylate (2.5) sulfate | 12.18 | 12.18 | 12.18 | 12.18 | 12.18 | 12.18 | 12.18 |
| Sodium $C_{12-15}$ Alkyl sulfate | 4.49 | 4.49 | 4.49 | 4.49 | 4.49 | 4.49 | 4.49 |
| $C_{9-11}$ alkyl polyethoxylate (8) | 4.17 | 4.17 | 4.17 | 4.17 | 4.17 | 4.17 | 4.17 |
| $C_{12}$ alkyl glucose amide | 4.17 | 4.17 | 4.17 | 4.17 | 4.17 | 4.17 | 4.17 |
| Citric acid | 1.92 | 1.92 | 1.92 | 1.92 | 1.92 | 1.92 | 1.92 |
| $C_{12-14}$ alkyl fatty acid | 3.21 | 3.21 | 3.21 | 3.21 | 3.21 | 3.21 | 3.21 |
| Ethanol-40b | 2.38 | 2.38 | 2.38 | 2.38 | 2.38 | 2.38 | 2.38 |
| 1,2-propanediol | 5.04 | 5.04 | 5.04 | 5.04 | 5.04 | 5.04 | 5.04 |
| Monoethanolamine | 0.15 | 0.15 | 0.15 | 0.15 | 0.15 | 0.15 | 0.15 |
| Sodium toluene sulfonate | — | 1.5 | 2.5 | — | — | — | — |
| Sodium cumene sulfonate | — | — | — | 3.0 | 5.0 | — | — |
| Sodium xylene sulfonate | — | — | — | — | — | 3.0 | 4.0 |
| Sodium hydroxide | to pH 8.0 | | | | | | |
| Boric acid | 2.88 | 2.88 | 2.88 | 2.88 | 2.88 | 2.88 | 2.88 |
| PEG 4000 | 0.51 | 0.51 | 0.51 | 0.51 | 0.51 | 0.51 | 0.51 |
| Tetraethylenepentamine ethoxylated (15–18) | 0.45 | 0.45 | 0.45 | 0.45 | 0.45 | 0.45 | 0.45 |
| Protease enzyme | 0.89 | 0.89 | 0.89 | 0.89 | 0.89 | 0.89 | 0.89 |
| Lipolase enzyme | 0.12 | 0.12 | 0.12 | 0.12 | 0.12 | 0.12 | 0.12 |
| Cellulase enzyme | 0.18 | 0.18 | 0.18 | 0.18 | 0.18 | 0.18 | 0.18 |
| FWA-3 | 0.048 | 0.048 | 0.048 | 0.048 | 0.048 | 0.048 | 0.048 |
| Water, perfume, and minor ingredients | balance | | | | | | |

-continued

| | Component | | | | | | |
|---|---|---|---|---|---|---|---|
| | 1 | 2 | 3 | 4 | 5 | 6 | 7 |
| | Weight Percent Active | | | | | | |
| RESULTS: | | | | | | | |
| As Made | Hazy | Clear | Clear | Hazy | Hazy | Hazy | Clear |
| Static 40° F. | Cloudy | Hazy | Clear | Cloudy | Hazy | Hazy | Clear |
| Freeze/thaw 0° F.–50° F. | Cloudy | Hazy | Clear | Hazy | Hazy | Hazy | Clear |

Formulas are graded on a pass/fail basis, with pass denoting a clear isotropic liquid and fail denoting any evidence of crystallization. Formulas are graded on an as made basis, on a static storage at 40° F. basis, and on a recovery at 50° F. from a 0° F. freeze basis. The results show that the liquid detergent formulas utilizing sodium toluene sulfonate (NaTS) exhibit pronounced benefits for preventing phase split as made and/or phase stability. Compared to the other hydrotropes, sodium toluene sulfonate provides these benefits at a significantly reduced level. At a level as low as 1.5% by weight, sodium toluene sulfonate prevents the formula (as made) from phase splitting. For sodium xylene sulfonate, 4% is required in the formula before a clear product is obtained. Sodium cumene sulfonate is not able to provide phase stability or prevent phase split as made.

What is claimed is:

1. A concentrated heavy duty liquid laundry detergent composition comprising, by weight of the composition:

a) from about 10% to about 25% of an anionic surfactant component which comprises between about 75% and 100% of alkyl polyethoxylate sulfates wherein the alkyl group contains from about 10 to about 22 carbon atoms and the polyethoxylate chain contains from 1 to about 4 ethylene oxide moieties;

b) about 10% of a polyhydroxy fatty acid amide surfactant of the formula:

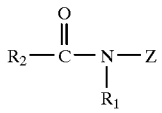

wherein $R_1$ is H, $C_1$–$C_4$ hydrocarbyl, 2-hydroxy ethyl, 2-hydroxy propyl, methoxy ethyl, methoxy propyl, or a mixture thereof, $R_2$ is $C_5$–$C_{31}$ hydrocarbyl, and Z is a polyhydroxyhydrocarbyl having a linear hydrocarbyl chain and at least 3 hydroxys directly connected to said chain, or an alkoxylated derivative thereof;

c) about 8% of water-soluble salt of toluene sulfonic acid;

d) no more than 50% of water;

wherein the concentration of all surfactants in the detergent composition is greater than about 15% by weight of the composition.

2. The composition of claim 1 wherein $R_1$ is methyl, $R_2$ is $C_9$–$C_{17}$ alkyl or alkenyl, Z is —$CH_2(CHOH)_nCH_2OH$, —$CH(CH_2OH)$—$(CHOH)_{n-1}$—$CH_2OH$, or —$CH_2$—$(CHOH)_2(CHOR')(CHOH)$—$CH_2OH$ wherein n is an a integer from 3 to 5, inclusive, and R' is H or a cyclic or aliphatic monosaccharide.

3. The composition of claim 2 wherein $R_1$ is methyl, $R_2$ is $C_9$–$C_{17}$ alkyl or alkenyl, Z is —$CH_2(CHOH)_nCH_2OH$, —$CH(CH_2OH)$—$(CHOH)_{n-1}$—$CH_2OH$, or —$CH_2$—$(CHOH)_2(CHOR')(CHOH)$—$CH_2OH$ wherein n is an integer from 3 to 5, inclusive, and R' is H or a cyclic or aliphatic monosaccharide.

4. The composition of claim 3 wherein Z is —$CH_2(CHOH)_4CH_2OH$.

5. The composition of claim 1 wherein the toluene sulfonate salt is selected from the group consisting of sodium toluene sulfonate, potassium toluene sulfonate, monoethanolamine toluene sulfonate, and mixtures thereof.

6. The composition of claim 1 further comprising from about 1% to about 10% by weight of an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (Hydrophilic-Lipophilic Balance) of from about 6 to about 14.

7. The composition of claim 1 further comprising from about 1% to about 20% of a detergent builder material.

8. The composition of claim 1 further comprising from about 1% to about 10% of citric acid.

* * * * *